US006595855B2

(12) United States Patent
Sako

(10) Patent No.: US 6,595,855 B2
(45) **Date of Patent: *Jul. 22, 2003**

(54) ELECTRONIC LOTTERY SYSTEM AND ITS OPERATING METHOD AND COMPUTER-READABLE RECORDING MEDIUM IN WHICH THE ELECTRONIC LOTTERY PROGRAM CODE IS STORED

(75) Inventor: Kazue Sako, Tokyo (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/010,180

(22) Filed: Jan. 21, 1998

(65) Prior Publication Data

US 2001/0053714 A1 Dec. 20, 2001

(30) Foreign Application Priority Data

Jan. 27, 1997 (JP) ..... 9-027236

(51) Int. Cl.[7] ..... A63F 9/24

(52) U.S. Cl. ..... 463/29; 463/16; 463/17; 463/22; 463/42

(58) Field of Search ..... 463/16, 17, 18, 463/40, 41, 42, 29, 25; 380/23, 24, 25, 28, 30

(56) References Cited

U.S. PATENT DOCUMENTS 5,297,206 A * 3/1994 Orton ..... 380/30
5,354,069 A * 10/1994 Guttman et al. ..... 463/17
5,507,489 A * 4/1996 Reibel et al.
5,643,086 A * 7/1997 Alcorn et al.
5,871,398 A * 2/1999 Schneier et al. ..... 463/16
5,970,143 A * 10/1999 Schneier et al. ..... 380/23
5,999,808 A * 12/1999 LaDue
6,024,640 A * 2/2000 Walker et al.
6,099,408 A * 8/2000 Schneier et al.

FOREIGN PATENT DOCUMENTS

| | | |
|---|---|---|
| EP | WO 80-02512 | 11/1980 |
| EP | 0 625 760 A1 | 5/1994 |
| JP | 61-18085 | 1/1986 |
| JP | 1-319896 | 12/1989 |
| JP | 5-124305 | 5/1993 |
| JP | 6-96109 | 4/1994 |
| JP | 7-131533 | 5/1995 |
| JP | 7-287731 | 10/1995 |
| JP | 8-101872 | 4/1996 |

* cited by examiner

*Primary Examiner*—Michael O'Neill

(57) ABSTRACT

Using a encrypting function, a server encrypts a random number x which is generated by a random number generation means, and it, along with both the encrypting function and a result function, is published. Each of the terminals (i) which will participate in the lottery sends a random number, which is a response, generated by its random number generation means. A result calculation means of the server calculates a lottery result by applying the response ri and the initial value x to the result function, and publishes the lottery result, the initial value x and the response ri. Each of the terminals (i) receives this information, and the result verification means determines whether the encrypted initial value equals the value calculated by applying the initial value to the encrypting function, and whether the response of each of the terminals is recorded, and whether the lottery result equals the value calculated by applying the result function to the initial value x and the response ri.

21 Claims, 9 Drawing Sheets

ELECTRONIC LOTTERY SYSTEM AND ITS OPERATING METHOD AND COMPUTER-READABLE RECORDING MEDIUM IN WHICH THE ELECTRONIC LOTTERY PROGRAM CODE IS STORED

BACKGROUND OF THE INVENTION

The present invention relates to an electronic lottery system composed of a server and a plurality of terminals, which electronically draw lots.

Many conventional systems using mechanical methods to draw lots have previously been proposed, described as follows:

Laid-open Hei7-131533 (hereafter, referred to as reference 1) shows the "Lottery application reception system", in which telephones are utilized in the operation of a lottery in such a way that the server accepts lottery applications via the push-tone signals or acoustic signals sent by telephone from the terminals.

Laid-open Hei8-101872 (hereafter, referred to as reference 2) shows the "Facility reservation management system", in which the server accepts the reservation of a facility sent from a terminal, and draws lots when reservations conflict, and then notifies the result of the lot drawing to the terminals.

Laid-open Hei7-287731 (hereafter, referred to as reference 3) shows the "Network-type card lottery management apparatus and central card lottery management method", in which a central data management apparatus in the server accepts lottery applications using lottery cards from a terminal data management apparatus in the terminals and then draws lots, and then notifies the results to the terminals.

Laid-open Sho61-18085 (hereafter, referred to as reference 4) shows the "Public lottery apparatus", located in the terminal, which issues a public lottery ticket with a public lottery number that a person wants.

Laid-open Hei1-319896 (hereafter, referred to as reference 5) shows the "Electronic cash register with a lottery function", which draws lots by generating a random number when its sum-up key is pushed, and then determines whether this number matches a prize number previously stored in its memory.

Laid-open Hei5-124305 (hereafter, referred to as reference 6) shows the "Print-out processing method" of increasing a lottery's drama by hiding the result of an Amitabha-type lottery in such a way that it suspends the print-out when an Amitabha-type lottery drawing is printed out and then resumes the operation.

Laid-open Hei6-96109 (hereafter, referred to as reference 7) shows the "game apparatus", which provides a resultant lottery by electronically generating an Amitabha-type pattern with several long lines along which include short lines bridged between the long lines, and displaying them, and then selecting one of the long lines according to people's requests.

As described above, there are many conventional proposals for using mechanical methods to draw lots. However, these methods have the objective of automating the reception of applications to enter the lottery and then the drawing of lots. Impartiality, which is a most important factor in a lottery, is not sufficiently taken into account. For instance, in references 1 and 2, the server draws lots, but does so without assuring that the lottery operation is impartially performed. In reference 3, the lottery is performed in accordance with a recorded number on a card; however, this system is vulnerable to unfair acts such as an act of altering the number recorded on the card. The use of the method detailed in reference 4 can prevent the lottery numbers from being altered since they are printed on public lottery tickets, but there is no guarantee of an impartial lottery being made by the server. In the method detailed in reference 5, the fact that a random number is generated cannot prevent the possibility of unfair acts being made because a prize number which has previously been stored in the memory can be altered. In the methods detailed in references 6 and 7, the act of drawing lots is accomplished using an Amitabha-type lottery pattern which is selected by the apparatus. The pattern can be easily altered after lottery applications are accepted, thus resulting in a profitable result for a certain person.

As described above, using the server to determine the lottery result creates the possibility that unfair operations will lead to a specific lottery result being made. When the result of drawing lots is determined before terminals participate, there is the possibility that one or more of the terminals can cheat.

SUMMARY OF THE INVENTION

The objective of the present invention is to provide an electronic lottery method and system, by which a lottery result is obtained in accordance with random numbers selected by a server and a plurality of terminals. None of subsystems can cheat the lottery result. Another objective of the present invention is to provide a computer-readable recording medium, on which an electronic lottery program code is recorded, and by which the electronic lottery operations are performed.

In accordance with a first embodiment of the invention, a server generates a random number x, determines other settings such as a result function R and an encrypting function H, encrypts the random number x using the encrypting function H to produce an encrypted random number H(x), and publishes the encrypting function H, the result function R, and the encrypted random number H(x). Terminals then obtain the published encrypting function H, result function R, and encrypted random number H(x), and then generate respective random numbers ri and send those random numbers ri to the server. The server verifies each received random number ri using a signature of the terminal, normalizes the random numbers ri, and calculates a lottery result R(x, r) using the random number x generated by the server and the random numbers ri generated by the terminals. The server then publishes the lottery result R(x, r), each random number ri provided by the terminals, and the random number x generated by the server. These values are obtained by each terminal, and each terminal verifies the correctness of its own random number ri, verifies the published random number x using the encrypting function H and the encrypted random number H(x), and verifies the lottery result R(x, r) using the result function R, the server random number x, and the terminal random numbers ri.

In accordance with a second embodiment of the invention, a server generates a random number x, determines other settings such as a result function R and an encrypting function H, encrypts the random number x using the encrypting function H to produce an encrypted random number H(x), and publishes the encrypting function H, the result function R, and the encrypted random number H(x). Terminals then obtain the published encrypting function H, result function R, and encrypted random number H(x). The terminals then generate respective random numbers yj, encrypt those random numbers using the encrypting function H to generate encrypted random numbers H(yj), and send those encrypted random numbers H(yj) to the server. The server verifies each received encrypted random number H(yj) using a signature of the terminal, and publishes all encrypted random numbers H(yj). Each terminal then obtains all published encrypted random numbers H(yj), verifies that all encrypted random numbers H(yj) of terminals in the lottery have been obtained, verifies that its own published encrypted random number H(yj) is correct, and if it is correct, sends its own random number yj to the server. The server receives the random numbers yj, verifies each random number yj using a signature of the corresponding terminal, verifies the value of each random number yj using the corresponding encrypted random number H(yj) and the encrypting function H, normalizes the random numbers yj, and calculates a lottery result R(x, y) using the random number x generated by the server and the random numbers yj generated by the terminals. The server then publishes the lottery result R(x, y), each random number yj provided by the terminals, and the random number x generated by the server. These values are obtained by each terminal, and each terminal verifies the correctness of its own random number yj, verifies the published random number x using the encrypting function H and the encrypted random number H(x), verifies all random numbers yj using the encrypting function H and the encrypted random numbers H(yj), and verifies the lottery result R(x, y) using the result function R, the server random number x, and the terminal random numbers yj.

A third embodiment comprises first terminals of the type described with respect to the first embodiment, and further comprises second terminals of the type described with respect to the second embodiment. In the third embodiment, the result generation function R determines a result R(x, r, y) using a random number x generated by the server, random numbers ri generated by the first terminals, and random numbers yj generated by the second terminals. The processing in the terminals allows each terminal to verify the encrypted random numbers supplied by the second terminals.

In the third embodiment, a server generates a random number x, determines other settings such as a result function R and an encrypting function H, encrypts the random number x using the encrypting function H to produce an encrypted random number H(x), and publishes the encrypting function H, the result function R, and the encrypted random number H(x). First terminals (i) as described in the first embodiment obtain the published encrypting function H, result function R, and encrypted random number H(x), then generate respective random numbers ri, and send those random numbers ri to the server. The server receives the random numbers ri, and verifies each received random number ri using a signature of the terminal.

Concurrently, second terminals (j) as described in the second embodiment obtain the published encrypting function H, result function R, and encrypted random number H(x). The second terminals then generate respective random numbers yj, encrypt those random numbers using the encrypting function H to generate encrypted random numbers H(yj), and send those encrypted random numbers H(yj) to the server. The server receives each encrypted random numbers H(yj), and verifies each received encrypted random number H(yj) using a signature of the terminal.

The server then verifies that all random numbers ri and all encrypted random numbers H(yj) have been received from the respective terminals, and publishes all random numbers ri and all encrypted random numbers H(yj).

The first terminals (i) obtain all published random number ri and encrypted random numbers H(yj), verify that the random numbers ri and encrypted random numbers H(yj) of all terminals have been received, and verify that their own random number ri is published correctly. Concurrently, the second terminals (j) obtain all published random number ri and encrypted random numbers H(yj), verify that the random numbers ri and encrypted random numbers H(yj) of all terminals have been received, and verify that their own encrypted random number H(yj) is published correctly, and if published correctly, send their random number yj to the server.

The server receives the random numbers yj, verifies each random number yj using a signature of the corresponding terminal, verifies the value of each random number yj using the corresponding encrypted random number H(yj) and the encrypting function H, normalizes the random numbers ri and yj, and calculates a lottery result R(x, r, y) using the random number x generated by the server and the random numbers ri and yj generated by the terminals. The server then publishes the lottery result R(x, r, y), each random number ri and yj provided by the terminals, and the random number x generated by the server.

The published values are obtained by the first terminals (i), and each terminal verifies the correctness of its own random number ri, verifies the published random number x using the encrypting function H and the encrypted random number H(x), verifies that all random numbers yj of the second terminals are correct using the encrypting function H and the encrypted random numbers H(yj), and verifies the lottery result R(x, r, y) using the result function R, the server random number x, and the terminal random numbers ri and yj. Concurrently, the published values are obtained by the second terminals (j), and each terminal verifies the correctness of its own random number yj, verifies the published random number x using the encrypting function H and the encrypted random number H(x), verifies that all random numbers yj of the second terminals are correct using the encrypting function H and the encrypted random numbers H(yj), and verifies the lottery result R(x, r, y) using the result function R, the server random number x, and the terminal random numbers ri and yj.

In each of the embodiments, the server may use a hash function, such as the MD5 or the RIPE-MD, to encrypt the random numbers and also to obtain the lottery result. The terminals can also use such functions to encrypt their random numbers.

The invention may be embodied in methods, programmed machines, and computer readable media storing programming instructions.

BRIEF DESCRIPTION OF THE DRAWINGS

Other features and advantages will become apparent from the following description when taken in conjunction with the accompanying drawings, in which.

DETAILED DESCRIPTION OF THE PREFERRED EMBODIMENTS

Figure 1:
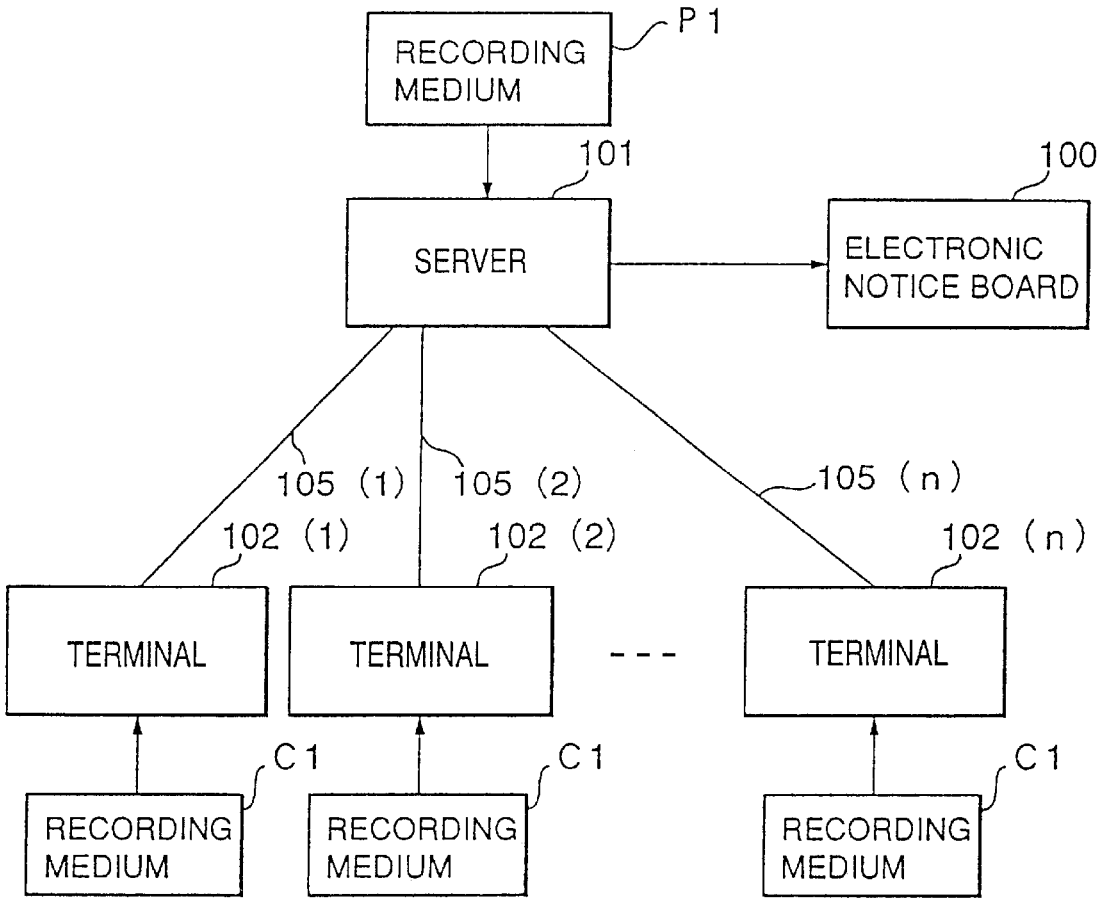
FIG. 1 shows the entire configuration of a first embodiment according to the present invention.

Referring to the drawings, the details of an embodiment of the invention will be described.

FIG. 1 shows the entire configuration of the first embodiment according to the present invention. An example of the electronic lottery system comprises a server 101, several terminals 102(i=1~n), a communication channel (e.g., a data line) 105(i) connecting between a server 101 and several terminals 102(i), and an electronic notice board 100. The server 101 and each of the terminals 102(i) comprise recording media P1 and C1, respectively. The recording media P1 and C1 can be a magnetic disk, semiconductor memory or other recording media. Further, a communication apparatus with a broadcasting function can be used in place of the electronic notice board 100.

Figure 2:
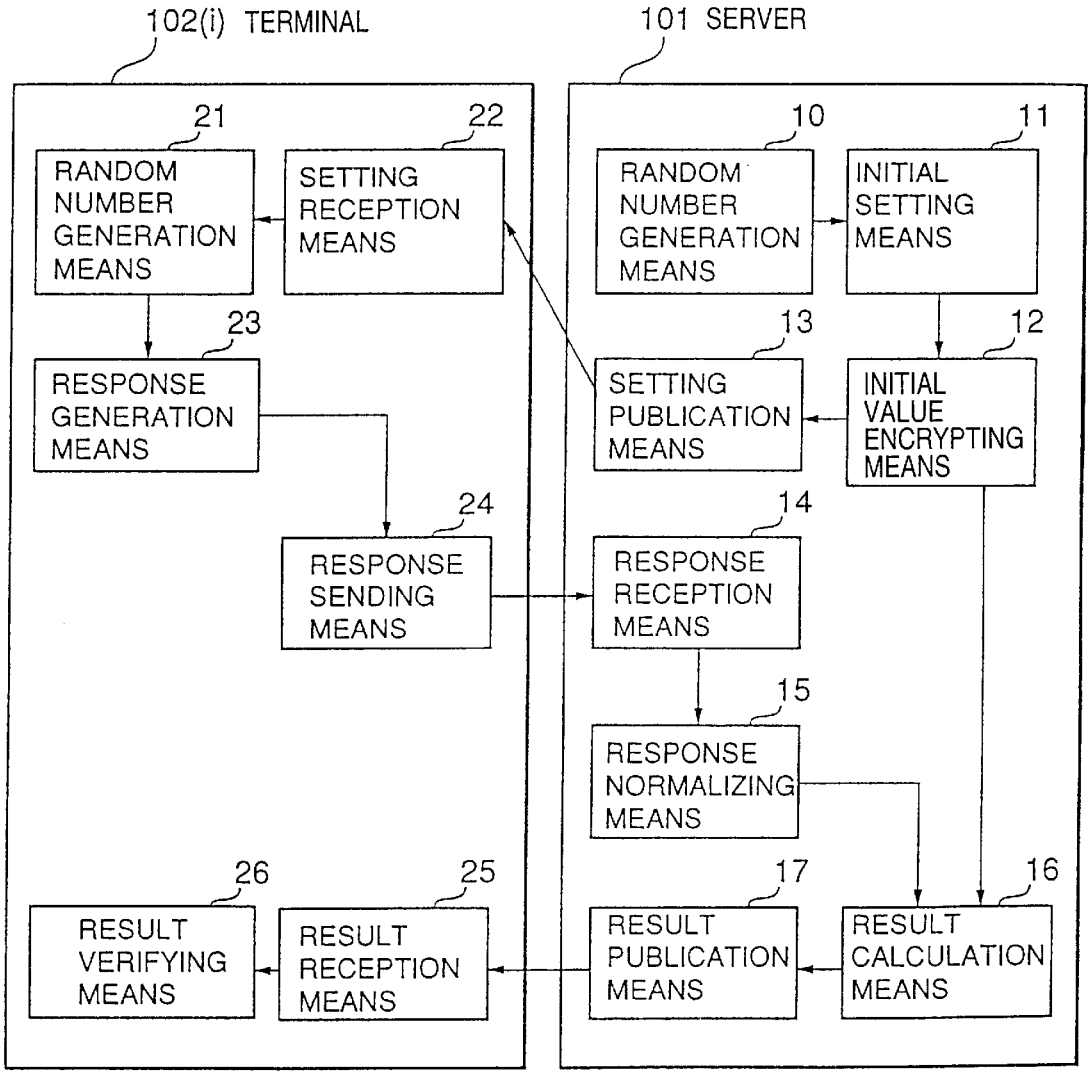
FIG. 2 shows the configuration of a server 101 and terminals 102(i)

FIG. 2 shows an example configuration of the server 101 and the terminals 102(i) in FIG. 1. The lottery program for the server which has been recorded in the recording medium P1 in FIG. 1 is read into a computer comprising the server 101, and then used to control the operation of the computer to provide the following functional units: a random number generation means 10, an initial setting means 11, an initial value encrypting means 12, a setting publication means 13, a response reception means 14, a response normalizing means 15, a result calculation means 16 and a result publication means 17 in the server 101. The lottery program for the terminals is read into a computer comprising the terminals 102(i), and used to control the operation of the computer to provide the following functional units: a random number generation means 21, a setting reception means 22, a response generation means 23, a response sending means 24, a result reception means and a result verifying means 26 in each of the terminals 102.

Figure 7:
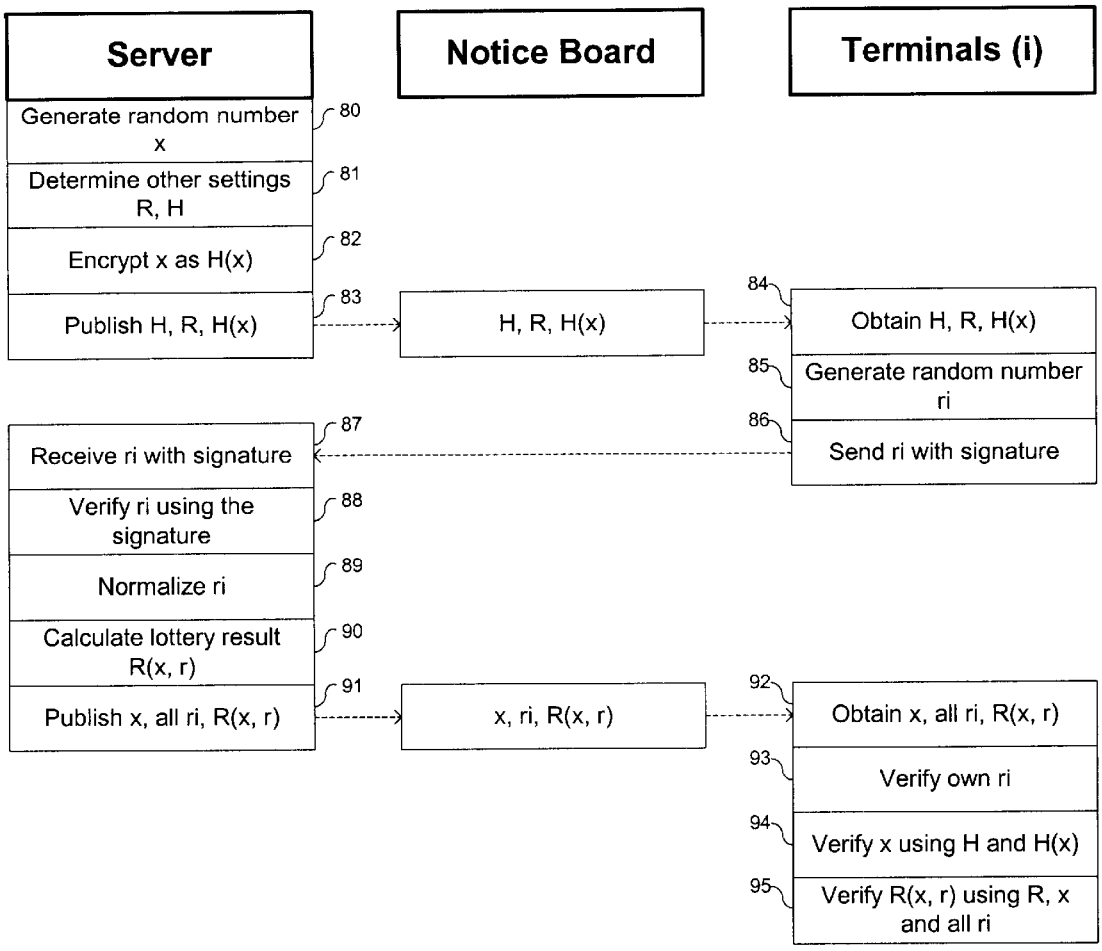
FIG. 7 shows processing performed by a server and terminals in accordance with the first embodiment.

FIG. 7 summarizes the processing that is performed in the system of the first embodiment. In accordance with the first embodiment, a server generates a random number x (80), determines other settings such as a result function R and an encrypting function H (81), encrypts the random number x using the encrypting function H to produce an encrypted random number H(x) (82), and publishes the encrypting function H, the result function R, and the encrypted random number H(x) (83). Terminals then obtain the published encrypting function H. result function R, and encrypted random number H(x) (84), then generate respective random numbers ri (85), and send those random numbers ri to the server (86). The server receives the random numbers ri (87), verifies each received random number ri using a signature of the terminal (88), normalizes the random numbers ri (89), and calculates a lottery result R(x, r) using the random number x generated by the server and the random numbers ri generated by the terminals (90). The server then publishes the lottery result R(x, r), each random number ri provided by the terminals, and the random number x generated by the server (91). These values are obtained by each terminal (92), and each terminal verifies the correctness of its own random number ri (93), verifies the published random number x using the encrypting function H and the encrypted random number H(x) (94), and verifies the lottery result R(x, r) using the result function R, the server random number x, and the terminal random numbers ri (95).

The processing of the first embodiment is now described in more detail. In the electronic lottery system of the embodiment, the following operation phases are performed to generate a lottery result:

initial setting phase response phase result calculation phase verification phase The operation of each of the phases will be described with reference to FIG. 1, FIG. 2 and FIG. 7.

Initial Setting Phase

First, in the server 101, a random number x is generated by the random number generation means 10. Then, the initial setting means 11 establishes the generated number as the initial value x, and at the same time determines other things, such as lottery participating terminals, the encrypting function H which will be used by the subsequent initial value encrypting means 12, the result function R which will be used by the subsequent result calculation means 16, the response method of the terminal, and the normalizing method. However, things other than the initial value x are unnecessary to be established each time, if they are already determined between the server 101 and the terminals 102(i), and their publication is therefore also unnecessary. Next, the initial value encrypting means 12 encrypts the initial value x as H(x) with the encrypting function H. Then the setting publication means 13 publishes on the electronic notice board 100 the encrypted initial value H(x), as well as the other things, such as the names of participating terminals, the encrypting function H, the result function R, the response method of the terminals and the normalizing method, which together comprise initial settings.

Response Phase

When the setting reception means 22 in each of the terminals 102(i) receives the initial settings published on the electronic notice board, the random number generation means 21 generates the random number ri. Next, the response generation means 23 generates response data, including the random number ri generated by the random number generation means 21 in accordance with the response method of the terminal given the published initial setting information, and then the response sending means 24 sends the random number ri to the server 101. In addition, a digital signature data can be attached to the response data, and also be sent by the response sending means 24.

Result Calculation Phase

The response reception means 14 in the server 101 receives the response data including the random number ri from each of the terminals 102(i). When the response reception means 14 receives the response data with digital signature data, verification of the response data is performed. Next, the response normalizing means normalizes the received response data, extracting no more from the response data than the digital signature data. Moreover, a prescribed value can be assigned for a terminal which has not responded within a predetermined period of time. The responses from respective terminals 102(i) are arranged in a prescribed order, and the arranged responses are named as r. For instance, r can be a concatenation of respective responses r1, r2, . . . in order. Next, the result calculation means 16 calculates the lottery result R(x, r) by substitution of the r and the initial value x for the corresponding parameters in the result function R. Following that, the result publication means 17 publishes the response ri and the initial value x and the lottery result R(x, r) on the electronic notice board 100.

Verification Phase

Each of the terminals 102(i) receives the contents published on the electronic notice board 100, including the lottery result R(x, r), the initial value x, and the response ri from the result reception means 25. Then, the result verification means 26 verifies the following items to determine whether an impartial lottery result has been generated:

that the response ri is described correctly;

that the correct H(x) results from the substitution of the initial value x for the corresponding parameter in the encrypting function H; and that the correct lottery result R(x, r) results from the substitution of the normalized result r of each response and the initial value x for the lottery result R(x, r).

A function by which the encrypting process can be easily performed but breaking the encrypt is very difficult is used as the encrypting function H. The commitment function, one-way function, ciphering function and hash function, such as the MD5 or the RIPE-MD, can all be used for the encrypting function H. For the result function R, a function by which the lottery result can be calculated according to the x and r is used. The one-way function, decoding function and one-way hash function can all be used for the function R. For references on the common encryption technology, "Applied Cryptography", by Bruce Schneier, John Wiley & Sons, Inc., 1993 details specific examples of the commitment function, one-way function, encryption function and one-way hash function.

According to the electronic lottery system, a lottery result dependent upon the initial value x set by the random number generation means in the server 101 and the random number ri generated by the random number generation means 21 in each of the terminals 102(i) is obtained. Moreover, since the initial value x has been published in an encrypted manner, none of the terminals 102(i) can learn the initial value x while deciding its response, and the server 101 cannot change the initial value x after it receives responses from the terminal 102(i). By this manner, an impartial lottery is conducted.

Figure 3:
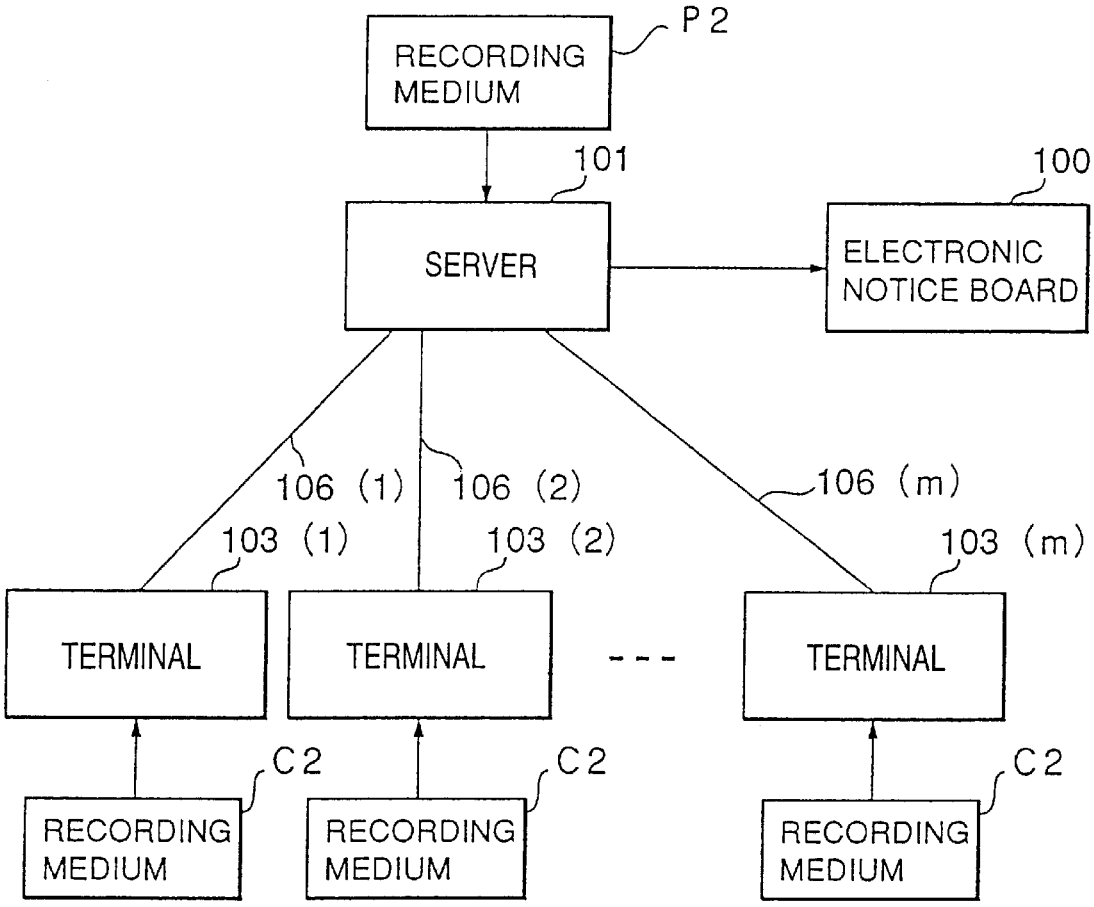
FIG. 3 shows the entire configuration of a second embodiment according to the present invention.

FIG. 3 shows the entire configuration of the second embodiment according to the present invention. An example of the electronic lottery system comprises a server 101, a plurality of terminals 103(j) (j=1~m), a communication channel 106(j) (e.g., a data communication line) which reliably connects the server 101 and the plurality of the terminals 103(j) (j=1~m), and an electronic notice board 100 on which the server publishes information. Moreover, the server 101 and each of the terminals 103(j) comprises recording media P1 and P2 on which the electronic lottery program is recorded. The recording media P1 and P2 can be one of various recording media, such as magnetic disk, semiconductor memory or other media. Additionally, a communication apparatus with a broadcasting function can be used instead of the electronic notice board 100.

Figure 4:
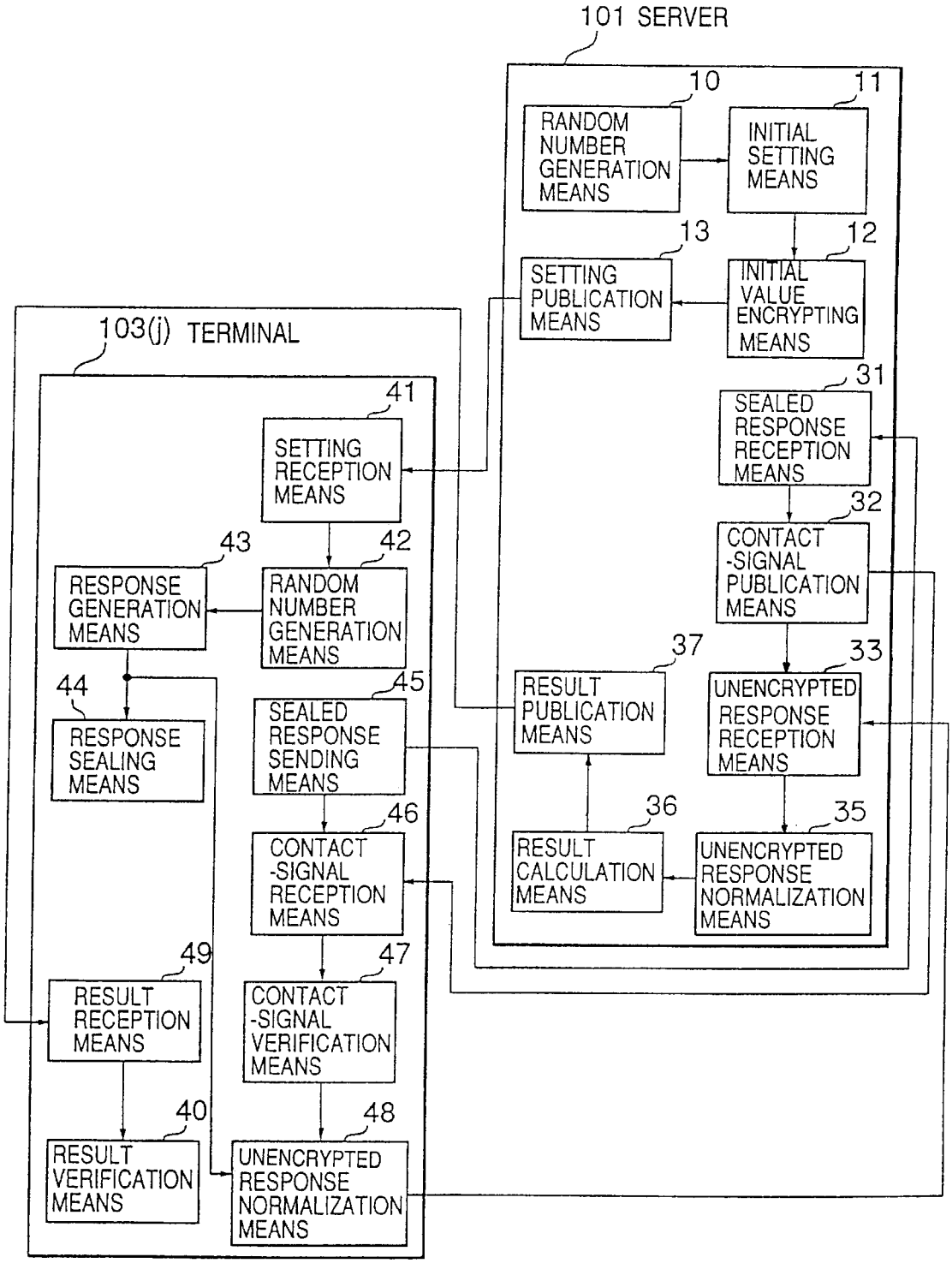
FIG. 4 shows the configuration of a server 101 and terminals 103(j)

FIG. 4 shows an example configuration of the server 101 and the terminal 103(j) of FIG. 3. The lottery program for the server, which is recorded on the recording medium P2 as shown in FIG. 3, is read into a computer comprising the server 101. Therewith, the operations of the random number generation means 10, the initial setting means 11, the initial value encrypting means 12, the encrypted response reception means 31, the contact-signal publication means 36, the unencrypted response reception means 33, the unencrypted response normalizing means 35, and the result calculation means 32 can be performed in the server 101. The lottery program for the terminal which is recorded on the recording media c2 is read into a computer comprising the terminal 103(j), and with which the operations of the computer are performed. Therewith, the operations of the setting reception means 41, the random number generation means 42, the response generation means 43, response encrypting means 44, the encrypted response sending means 45, the contact-signal reception means 46, the contact-signal verification means 47, the unencrypted response sending means 48, the result reception means 49 and the result verification means 40 can be performed in the terminals 103(j).

Figure 8:
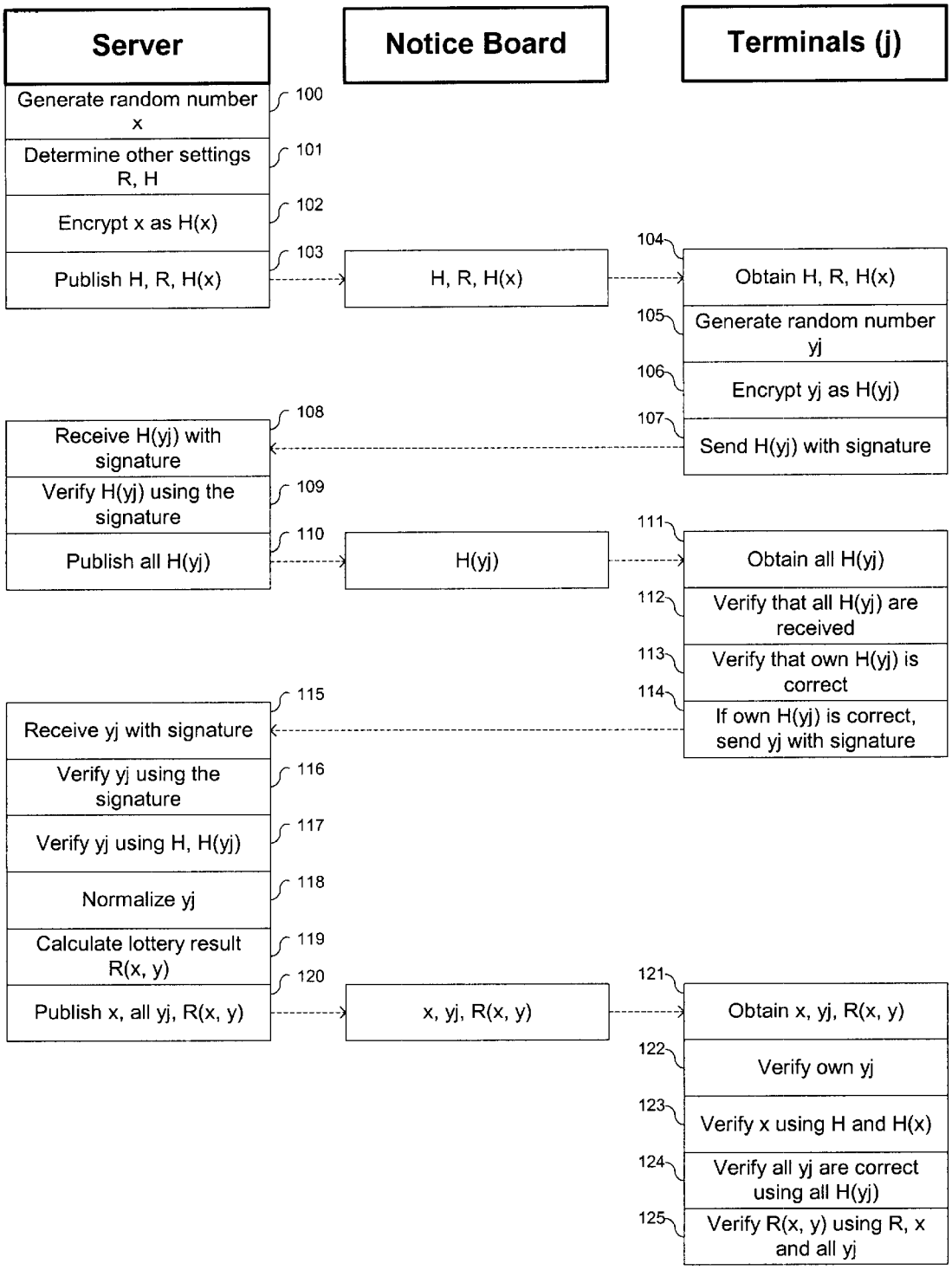
FIG. 8 shows processing performed by a server and terminals in accordance with the second embodiment.

FIG. 8 summarizes the processing that is performed in the system of the second embodiment. In accordance with the second embodiment, a server generates a random number x (100), determines other settings such as a result function R and an encrypting function H (101), encrypts the random number x using the encrypting function H to produce an encrypted random number H(x) (102), and publishes the encrypting function H, the result function R, and the encrypted random number H(x) (103). Terminals then obtain the published encrypting function H, result function R, and encrypted random number H(x) (104). The terminals then generate respective random numbers yj (105), encrypt those random numbers using the encrypting function H to generate encrypted random numbers H(yj) (106), and send those encrypted random numbers H(yj) to the server (107). The server receives each encrypted random number H(yj) (108), verifies each received encrypted random number H(yj) using a signature of the terminal (109), and publishes all encrypted random numbers H(yj) (110). Each terminal then obtains all published encrypted random numbers H(yj) (111), verifies that all encrypted random numbers H(yj) of terminals in the lottery have been obtained (112), verifies that its own published encrypted random number H(yj) is correct (113), and if it is correct, sends its own random number yj to the server (114). The server receives the random numbers yj (115), verifies each random number yj using a signature of the corresponding terminal (116), verifies the value of each random number yj using the corresponding encrypted random number H(yj) and the encrypting function H (117), normalizes the random numbers yj (118), and calculates a lottery result R(x, y) using the random number x generated by the server and the random numbers yj generated by the terminals (119). The server then publishes the lottery result R(x, y), each random number yj provided by the terminals, and the random number x generated by the server (120). These values are obtained by each terminal (121), and each terminal verifies the correctness of its own random number yj (122), verifies the published random number x using the encrypting function H and the encrypted random number H(x) (123), verifies all random numbers yj using the encrypting function H and the encrypted random numbers H(yj) (124), and verifies the lottery result R(x, y) using the result function R, the server random number x, and the terminal random numbers yj (125).

The processing of the second embodiment is now described in more detail. To generate a lottery result, the electronic lottery system of the second embodiment performs:

an initial setting phase;

a response encrypting phase;

a response unencrypting phase;

a result calculation phase; and a verification phase

Thereby, the electronic lottery is performed. Next, each of the phases will be described with reference to FIG. 3, FIG. 4 and FIG. 8.

Initial Setting Phase

The initial setting phase is the same as that of the first embodiment. Specifically, the random number generation means 10 in the server 101 generates the random number x. Then, the initial setting means 11 determines the initial value x according to the generated random number; at the same time all other factors are also determined, such as the terminals which will participate in the lottery, the encrypting function H which will be used by the initial setting means 12, the result function R which will be used by the subsequent result calculation means 36, the response method in the terminal, and the normalizing method. Things other than the initial value x do not need to be decided each time or published if they are decided in advance between the server 101 and the terminal 103(j). Next, the initial value encrypting means 12 encrypts the initial value x into H(x) using the encrypting function H. Then, the setting publication means 13 publishes on the electronic notice board 100 the encrypted initial value H(x) as well as the other factors, such as the terminals that are participating, the encrypting function H, the result function R, the response method in the terminal, and the normalizing method.

Response Encrypting Phase

When the setting reception means 41 in each of the terminals 103(j) receives the initial settings which are published on the electronic notice board 100, the random number generation means 42 generates a random number yj. Next, the response generation means 43 generates response data including the generated random number yj in accordance with the response method in the terminal as described in the published initial settings. Then, the response encrypting means 44 encrypts the response data including yj into H(yj) using the encrypting function H in the published initial settings, and the encrypted response sending means 45 sends the encrypted response H(yj) to the server 101. In the encrypted response sending means 45, a digital signature of the terminal 103(j) encrypted can be attached to the encrypted response H(yj). In the embodiment, the encrypting function H is the same as that used by the initial value encrypting means 12 in the server 101, but another encrypting function can also be used instead.

Response Unencrypting Reception Phase

The encrypted response reception means 31 in the server 101 receives the encrypted responses H(yj) from each of the terminals 103(j) At this time, the digital signature, if attached, is verified. When the encrypted responses H(yj) arrive from all terminals 103(j), the contact-signal publication means 32 publishes on the electronic notice board 100 the encrypted responses H(yj) received from the terminal 103(j).

When the contact-signal reception means 46 in each of terminals 103(j) receives the aforementioned contact signal H(yj) from the electronic notice board 100, it forwards the signal to the contact-signal verification means 47. The contact-signal verification means 47 determines whether all contact signals of terminals 103(j), or all encrypted responses H(yj) are received, and also determines whether its own encrypted responses have been noted correctly. If they are determined to be correct, the unencrypted response sending means sends the response yj (i.e., the response that the response generation means has made), as an unencrypted response, to the server 101. Further, in the unencrypted response sending means 48, a digital signature of the terminal 103(j) corresponding to the unencrypted response yj can be attached to the unencrypted response yj.

Result Calculation Phase

The unencrypted response reception means 33 in the server 101 receives the unencrypted response yj from each of the terminals 103(j) Then, the digital signature, if attached, is verified. Next, it is determined whether the unencrypted response yj reliably corresponds to the encrypted response H(yj) by substituting the unencrypted response for the corresponding parameter in the encrypting function H, and then comparing the resultant value to the encrypted response H(yj).

Next, the unencrypted response normalizing means 35 normalizes the unencrypted response yj from each of the terminals 103(j). Only the response without the digital signature (if attached) is taken. Then, the unencrypted responses from the respective terminals 103(j) are lined up in a predetermined order, wherein the arranged bit pattern is named as y. The y can be a concatenation of respective unencrypted responses in a predetermined order such as y1, y2, . . . Next, the result calculation means 36 calculates the lottery result R(x, y) in such a way that the y and the initial value x are both substituted for the corresponding parameters in the result function R. Then, the result publication means 37 publishes on the electronic notice board each unencrypted response yj from each terminal 103(j) and the initial value x and the lottery result R(x, y).

Verification Phase

The result reception means 49 in each of the terminals 103(j) receives the contents made publish on the electronic notice board 100, namely, the lottery result R(x, y), the initial value x and the unencrypted response yj of each terminal 103(j), and then determines the following items to verify whether or not an impartial lottery has taken place:

- whether its own unencrypted response yj is described correctly;
- whether the resultant value from substituting the initial value x for the corresponding parameter of the encrypting function H equals H(x);
- whether the resultant value from substituting the unencrypted response yj for the corresponding parameter in the encrypting function H equals H(yj); and
- whether the resultant value from substituting each unencrypted response normalizing result y and the initial value x for the corresponding parameters in the result function R, equals the lottery result R(x, y).

The hash function, such as the MD5 or the RIPE-MD, as well as the commitment function, one-way function, or ciphering function can be used for the encrypting function H in the same manner as in the first embodiment. Moreover, the one-way function, the decoding function, or the one-way hash function can be used for the result function R.

According to the aforementioned electronic lottery system, the initial value x is generated by the random number generation means 10 in the server 101 and the lottery result is dependent upon the random response number yj generated by the random number generation means 42. Since the initial value x is published in advance in an encrypted manner, the terminals 103(j) do not need to know the initial value x in order to determine their own responses. Accordingly, the server 101 cannot change the initial value x after receiving responses from the terminals 103(j). The server 101, in conjunction with some of the terminals 103(j), may leak the initial value x, but since the responses of the other terminals are published in an encrypted manner, the server 101 is not able to make a special response that is advantageous to any particular terminal 103(j). Therefore, an impartial lottery is realized.

Figure 5:
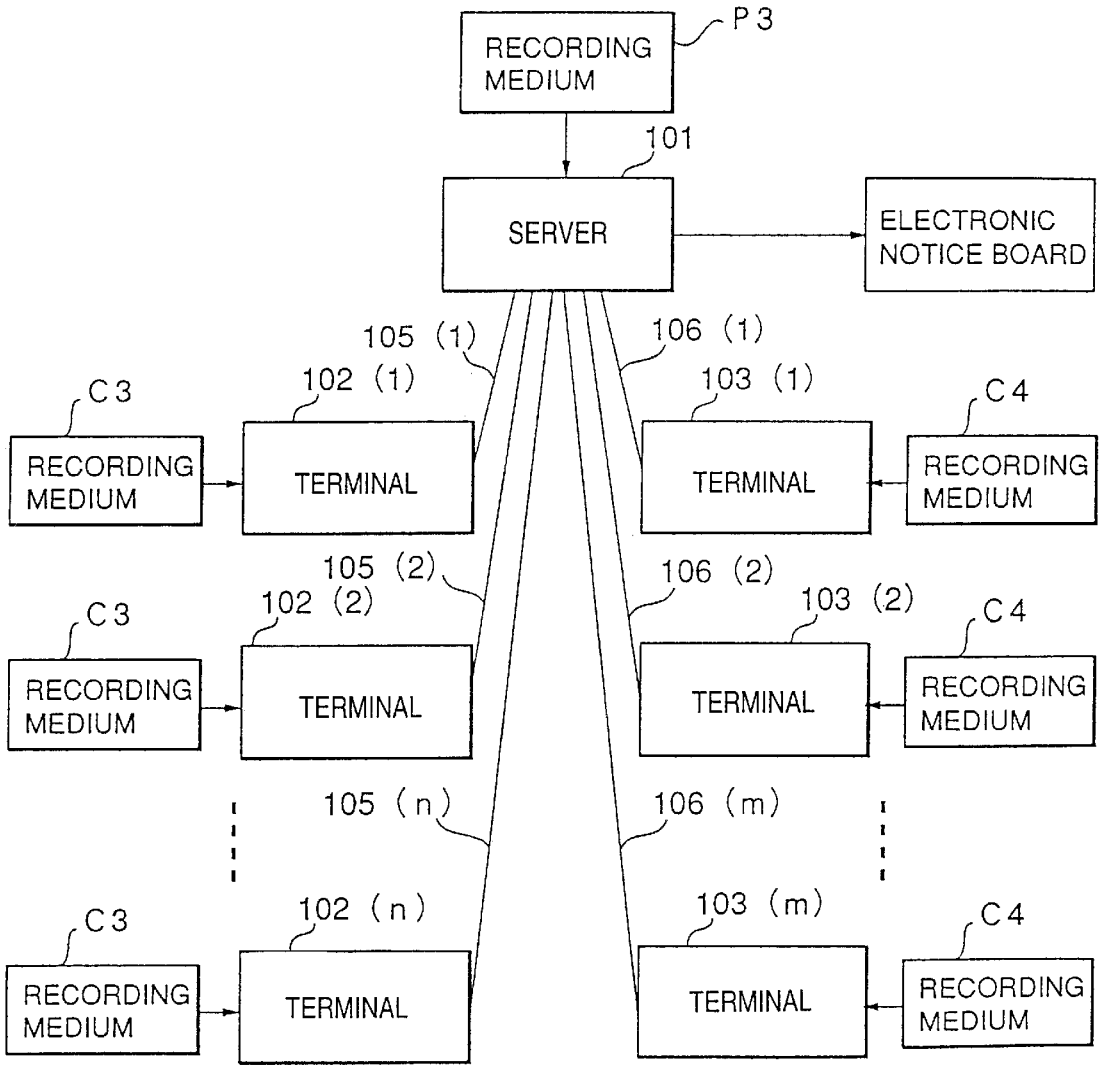
FIG. 5 shows the entire configuration of a third embodiment according to the present invention.

FIG. 5 shows the entire configuration of the third embodiment according to the present invention. The example of the electronic lottery system comprises a server 101, terminals 102(i) (i=1~n), terminals 103(j) (j=1~m), reliable communication channels 105(i) and 106(j) (e.g., a data communication line) which connects the server 101 with the terminals 102(i) and 103(j), and an electronic notice board 100 on which the server 101 can make information public. Moreover, the server 101 and each of the terminals 102(i) and 103(j) comprises recording media P3 and C3 and C4, respectively, on each of which an electronic lottery program is recorded. The recording media P3, C3 and C4 can be magnetic disk, semiconductor memory or other recording media. A communication apparatus with a broadcasting function can be used instead of the electronic notice board 100.

Figure 6:
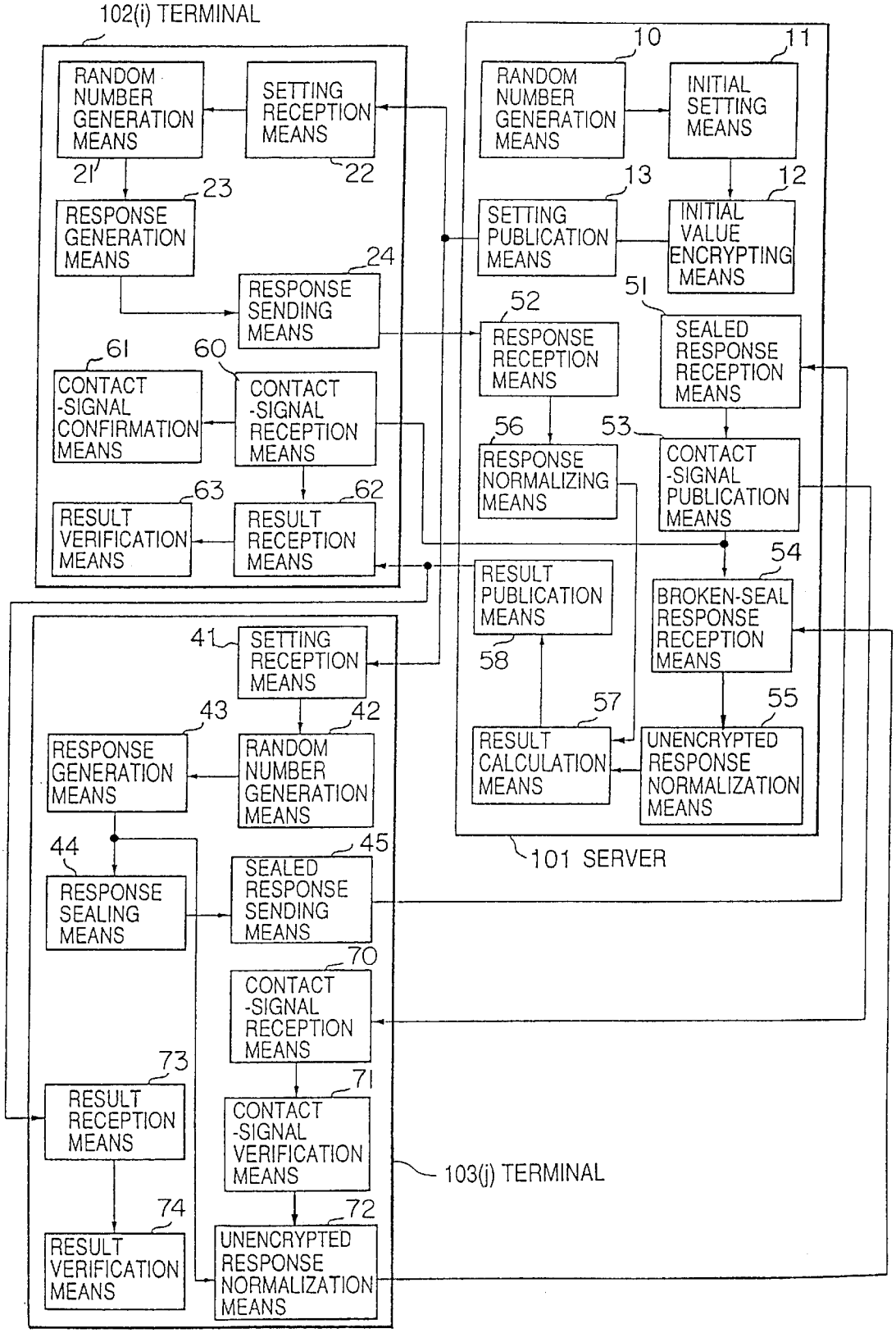
FIG. 6 shows the configuration of a server 101 and terminals 102(i) and 103(j)

FIG. 6 shows an example configuration of a server 101, terminals 102(i) and the terminals 103(j) from FIG. 5. The lottery program for the server, recorded on the recording medium P3 from FIG. 5, is read into a computer comprising the server 101 to control the operations of a random number generation means 10, an initial setting means 11, an initial value encrypting means 12, a setting publication means 13, an encrypted response reception means 31, a response reception means 14, a contact-signal publication means 32, an unencrypted response reception means 33, an unencrypted response normalizing means 35, a response normalizing means 15, a result calculation means 36 and a result publication means 37 in the server 101. Moreover, the lottery program for the terminals which has been recorded on each of the recording media C3, as shown in FIG. 5, is read into a computer comprising terminals 102(i) to control the operations of a random number generation means 42, a setting reception means 41, a reception generation means 43, response encrypting means 44, an encrypted response sending means 45, a contact-signal reception means 46, a contact-signal confirmation means 47, an unencrypted response normalization means 48, and a result verification means 40 in each of the terminals 102(i). Furthermore, the lottery program for the terminals recorded on each of the recording media C4, as shown in FIG. 5, is read into a computer comprising the terminals 103(j)to control the operations of a setting reception means 41, a random number generation means 42, a response generation means 43, a response encrypting means 44, an encrypted response sending means 45, a contact-signal reception means 70, a contact-signal verification means 71, an unencrypted response sending means 72, a result reception means 73, and a result verification means 74 in each of the terminals 103(j).

Figure 9:
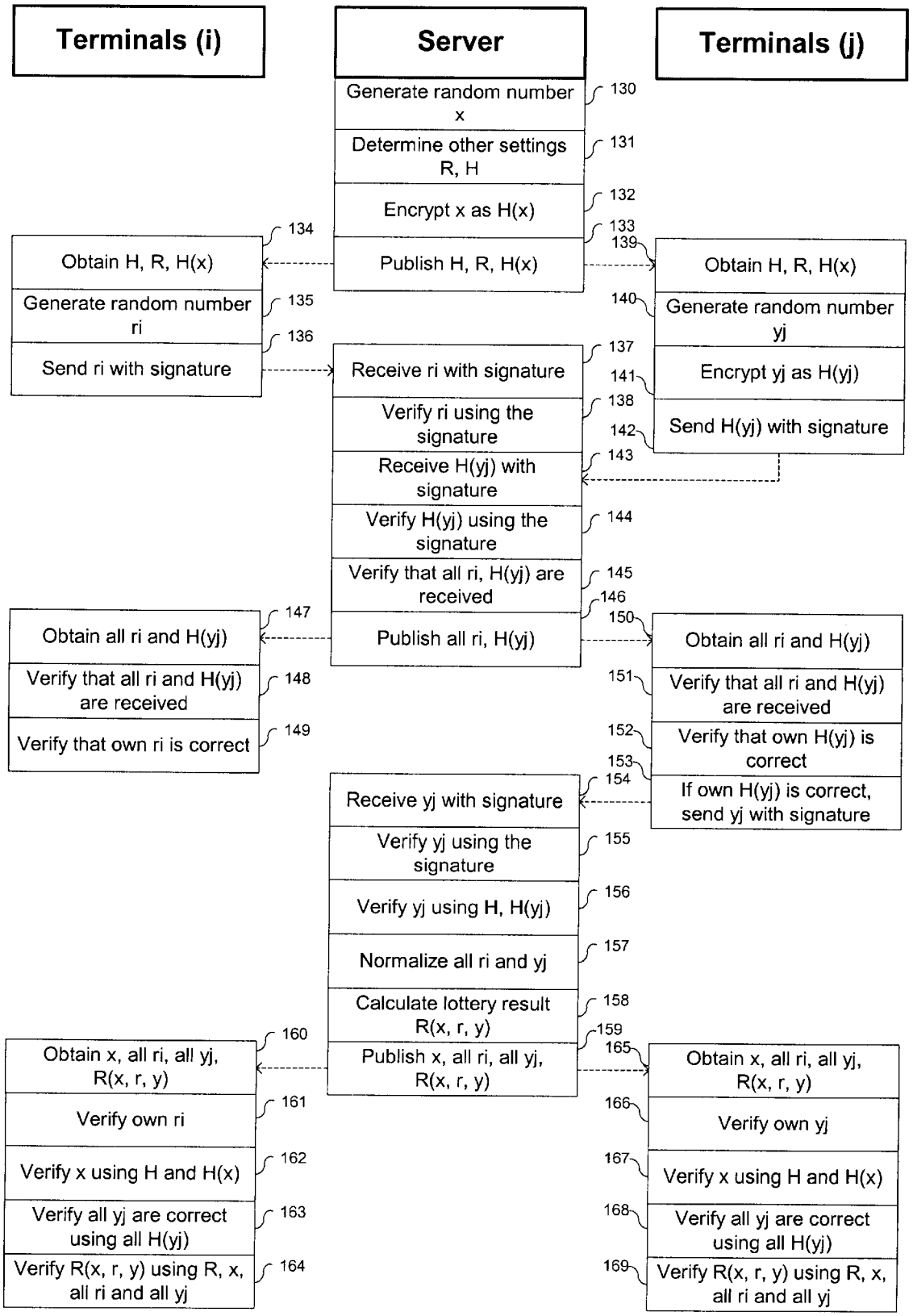
FIG. 9 shows processing performed by a server and terminals in accordance with the third embodiment.

FIG. 9 summarizes the processing that is performed in the system of the third embodiment. The processing illustrated in FIG. 9 omits illustration of the notice board that is illustrated in FIGS. 7 and 8. However it should be understood that where data is published by the server, that data is posted to a notice board to which the terminals of the system have access.

As shown in FIG. 9, a server generates a random number x (130), determines other settings such as a result function R and an encrypting function H (131), encrypts the random number x using the encrypting function H to produce an encrypted random number H(x) (132), and publishes the encrypting function H, the result function R, and the encrypted random number H(x) (133). First terminals (i) as described in the first embodiment obtain the published encrypting function H, result function R, and encrypted random number H(x) (134), then generate respective random numbers ri (135), and send those random numbers ri to the server (136). The server receives the random numbers ri (137), and verifies each received random number ri using a signature of the terminal (138).

Concurrently, second terminals (j) as described in the second embodiment obtain the published encrypting function H, result function R, and encrypted random number H(x) (139). The second terminals then generate respective random numbers yj (140), encrypt those random numbers using the encrypting function H to generate encrypted random numbers H(yj) (141), and send those encrypted random numbers H(yj) to the server (142). The server receives each encrypted random numbers H(yj) (143), and verifies each received encrypted random number H(yj) using a signature of the terminal (144).

The server then verifies that all random numbers ri and all encrypted random numbers H(yj) have been received from the respective terminals (145), and publishes all random numbers ri and all encrypted random numbers H(yj) (146).

The first terminals (i) obtain all published random numbers ri and encrypted random numbers H(yj) (147), verify that the random numbers ri and encrypted random numbers H(yj) of all terminals have been received (148), and verify that their own random number ri is published correctly (149). Concurrently, the second terminals (j) obtain all published random numbers ri and encrypted random numbers H(yj) (150), verify that the random numbers ri and encrypted random numbers H(yj) of all terminals have been received (151), and verify that their own encrypted random number H(yj) is published correctly (152), and if published correctly, send their random number yj to the server (153).

The server receives the random numbers yj (154), verifies each random number yj using a signature of the corresponding terminal (155), verifies the value of each random number yj using the corresponding encrypted random number H(yj) and the encrypting function H (156), normalizes the random numbers ri and yj (157), and calculates a lottery result R(x, r, y) using the random number x generated by the server and the random numbers ri and yj generated by the terminals (158). The server then publishes the lottery result R(x, r, y), each random number ri and yj provided by the terminals, and the random number x generated by the server (159).

The published values are obtained by the first terminals (i) (160), and each terminal verifies the correctness of its own random number ri (161), verifies the published random number x using the encrypting function H and the encrypted random number H(x) (162), verifies that all random numbers yj of the second terminals are correct using the encrypting function H and the encrypted random numbers H(yj) (163), and verifies the lottery result R(x, r, y) using the result function R, the server random number x, and the terminal random numbers ri and yj (164). Concurrently, the published values are obtained by the second terminals (j) (165), and each terminal verifies the correctness of its own random number yj (166), verifies the published random number x using the encrypting function H and the encrypted random number H(x) (167), verifies that all random numbers yj of the second terminals are correct using the encrypting function H and the encrypted random numbers H(yj) (168), and verifies the lottery result R(x, r, y) using the result function R, the server random number x, and the terminal random numbers ri and yj (169).

The third embodiment is now described in more detail. In the electronic lottery system of the third embodiment, electronic lottery operations are performed in the following phases:

an initial setting phase;

a response phase;

an encrypted response phase;

a response unencrypting phase;

a result calculation phase; and a verification phase

Each of these phases will be described below with reference to FIG. 5, FIG. 6 and FIG. 9.

Initial Setting Phase

The initial setting phase is the same as that of the first embodiment. In other words, the random number generation means in the server 101 generates a random number x, and then the initial setting means 11 establishes the generated random number as the random number x, and at the same time determines additional factors, such as which of the terminals will participate in the lottery, the encrypting function H which will be used by the initial value encrypting means 12, the result function R which will be used by the subsequent result calculation means 57, the response method of the terminals, and the normalizing method. Only the initial value x must be determined each time, if other factors have already been determined between the server 101 and the terminals 102(i) and 103(j) their publication is unnecessary. Next, the initial value encrypting means 12 encrypts the initial value x using the encrypting function H into H(x), and then the setting publication means 13 publishes on the electronic notice board 100 the encrypted initial value H(x) and the other factors such as which terminals will participate in, the encrypting function H, the result function R, the response method of the terminals and the normalizing method as initial settings.

Response Phase

The operation in the response phase is performed by each of the terminals 102(i). The content of the operation is the same as that of the first embodiment. Specifically, when the setting reception means 22 in each of the terminals 102(i) receives from the electronic notice board 100 the published initial setting information, the random number generation means 21 generates a random number ri. Following that, the response generation means 23 generates response data including the generated random number by the random generation means 21. Then, the response sending means 24 sends it to the server 101. Furthermore, the response sending means can send the digital signature of the terminal 102(i) corresponding to the response ri along with the ri.

Response Encrypting Phase

The operation of the response encrypting phase is performed in each of the terminals 103(j). Its content is the same as that of the second embodiment. When the setting reception means 41 in each of the terminals 103(j) receives from the electronic notice board 100 the published the initial setting information, the random number generation means 42 generates a random number yj. Next, the response generation means 43 generates response data including the generated random number yj in accordance with the response method in the terminal described in the published initial setting information. Then, the response encrypting means 44 encrypts the response data yj using the encrypting function H described in the published initial settings into H(yj), and the encrypted response sending means 45 sends the encrypted response H(yj) to the server 101. Further, the encrypted response sending means 45 can send a digital signature of the terminal 103(j) corresponding to the encrypted response H(yj) along with the encrypted response H(yj).

Response Unencrypting Phase

The encrypted response reception means 51 in the server 101 receives the encrypted response H(yj) from each of the terminals 103(j). The digital signature, if attached, is verified. The encrypted response reception means 52 receives the response ri from each of the terminals 102(i). The digital signature, if attached, is verified when the encrypted responses H(yj) arrive from all the terminals 103(j) and the responses ri arrive from all the terminals 102(i), the contact-signal publication means 32 publishes on the electronic notice board 100 the encrypted responses H(yj) from respective terminals 103(j) and the responses ri from respective terminals 102(i) as a contact signal.

When the contact-signal reception means 70 in each of terminals 103(j) receives the aforementioned contact signal from the electronic notice board 100, it forwards the signal to the contact-signal verification means 71. The contact-signal verification means 71 determines whether all contact signals of terminals 103(j), or all encrypted responses H(yj) and the response ri of each of the terminals 102(i) are obtained, and also determines whether its own encrypted responses have been noted correctly. If they are verified, the unencrypted response sending means sends the response yj (i.e., the response that the response generation means has made) as an unencrypted response, to the server 101. In the unencrypted response sending means 48, a digital signature of the terminal 103(j) corresponding to the unencrypted response yj can be attached to the unencrypted response yj.

The contact-signal reception means 60 in each of the terminals 102(i) receives the contact-signal published on the electronic notice board 100, and determines whether the encrypted responses of the respective terminals 103(j) and the responses of the respective subsystems 102(i) have been prepared, as well as whether its own response has been noted correctly.

Result Calculation Phase

The unencrypted response reception means of the server 101 receives the unencrypted response yj from each of the terminals 103(j). The digital signature in the received response, if attached, is verified. Whether the unencrypted response yj corresponds to the encrypted response H(j) correctly is determined by substituting the unencrypted response for the corresponding parameter in the encrypting function H, and then comparing the result with the encrypted response H(yj).

Next, the unencrypted response normalizing means 55 normalizes the unencrypted response yj from each of the terminals 103(j). When the encrypted response includes the digital signature, only the response without the digital signature is taken. Moreover, the encrypted responses from respective terminals 103(j) are lined up wherein the bit-pattern of the arranged responses is named as y. For example, y can be a concatenation of respective encrypted responses in a predetermined order, such as y1, y2, . . .

Next, the response normalizing means 56 normalizes each response ri from each of the terminals 102(i). For example, when the response includes the digital signature, only the response without the signature is taken, or a prescribed value is assigned to the terminal which has not responded within a predetermined period of time. Moreover, the bit-pattern of the lined-up responses from respective terminals 102(i) is named as r. For example, the r can be a concatenation of respective responses in a predetermined order, such as r1, r2, . . .

Next, the result calculation means 57 calculates the lottery result R(x, y, r) by substituting the y and r and the initial value x for: the corresponding parameters in the result function R. Next, the result publication means 58 publishes on the electronic notice board 100 the response yj from each of the subsystems 103(j), the response ri from each of the terminals 102(i), the initial value x and the lottery result R(x, y, r).

Verification Phase

The result reception means in each of the terminals 103(j) receives the contents published on the electronic notice board 100, or the lottery result R(x, y, r), the initial value x, the unencrypted response yj of each of the terminals 103(j) and the response ri of each of the terminals 102(i), and then the result verification means 74 determines whether an impartial lottery has occurred by determining the following:

whether its own unencrypted response yj has been noted correctly;

whether the resultant value from substituting the initial value x for the corresponding parameter of the encrypted function H, equals H(x);

whether the resultant value of substituting the unencrypted response yj for the corresponding parameter in the encrypting function H, equals H(yj); and whether the result value of substituting each unencrypted response yj normalizing result y, each response ri normalizing result r and the initial value x, for the corresponding parameters in the result function R, equals the lottery result R(x, y, r).

The result reception means 62 in each of the terminals 102(i) receives the contents published on the electronic notice board 100, and then the result verification means 63 determines whether the following items occurred in order to verify if an impartial lottery has occurred.

whether its own response yj has been noted correctly;

whether the resultant value from substituting the initial value x for the corresponding parameter of the encrypting function H, equals H(x);

whether the resultant value from substituting the unencrypted response yj of each of terminals 103(j) for the corresponding parameter in the encrypting function H, equals H(yj);

whether the resultant value from substituting each unencrypted response yj normalizing result y, each response ri normalizing result r and the initial value x for the corresponding parameters in the result function R, equals the lottery result R(x, y, r).

The hash function, such as the MD5 or the RIPE-MD, as well as the commitment function, one-way function, or ciphering function can all be used for the encrypting function H in the same manner as in the first and second embodiment. Moreover, the one-way function, the decoding function, or the one-way hash function can be used for the result function R.

According to the aforementioned electronic lottery system, the lottery result is dependent upon the initial value x which is set by the random number generation means 10 in the server 101, the random (response) number ri generated by the random number generation means 21 in each of the terminals 102(i) and the random (response) number ri generated by the random number generation means 42 in each of the terminals 103(j). Since the initial value x has been published in an encrypted manner, none of the terminals 102(i) or 103(j) know the initial value x when they decide their own response, while the server 101 cannot change the initial value x after it has received responses from the terminals. The server 101, in conjunction with some of the terminals, may leak the initial value x, but since the responses of the other terminals 103(j) are published in an encrypted manner, specially advantageous responses cannot be made if not in conjunction with all the terminals 103(j).

Thus, the terminals 103(j) of the third embodiment are the key to maintaining security. A terminal which has concerns about the possibility that other terminals, in conjunction with the server, might produce an unfair lottery result can take part in the procedure by acting as a terminal 103(j); on the other hand, a terminal which does not have concerns about such a possibility can participate in the lottery with less effort. Therefore, an impartial lottery can be realized.

According to the aforementioned invention, the following result can be obtained.

An impartial lottery result can be accomplished independent of the initial value randomly generated by the server and the responses generated by each of terminals.

Moreover, according to the second electronic lottery method and the electronic lottery system using it and a recording medium, upon which a computer-readable electronic lottery program is recorded, even though a server, in conjunction with some of the terminals, leaks the initial value, an advantageous responses for said same cannot be made, since the responses of the other terminals have been published in an encrypted manner. Thus, a more impartial lottery can be realized.

According to the third electronic lottery method and the electronic lottery system using it and a recording medium upon which a computer-readable electronic lottery program is recorded, since the second terminals are the key to maintaining security, a terminal which has concerns about the possibility that other terminals, in conjunction with the server, might produce an unfair lottery result can take part as a second terminal, while another terminal which does not have concerns about such a possibility can participate in the lottery without such an effort. Thus, an impartial and flexible lottery can be realized.

What is claimed is:

1. A server for an electronic lottery system, the server comprising a programmable machine programmed to perform processing comprising:

generating a random number x;

determining a encrypting function H and a result function R;

encrypting the random number x using the encrypting function H to generate an encrypted random number H(x);

publishing the encrypting function H, the result function R and the encrypted random number H(x);

receiving from terminals (i) of the lottery system respective random numbers ri;

calculating a lottery result R(x, r) using the result function R, the random number x, and the random numbers ri; and publishing the lottery result R(x, r) the random number x, and the random numbers ri.

2. The server claimed in claim 1, wherein the result function R is a first hash function.

3. The server claimed in claim 1, wherein the encrypting function H is a second hash function.

4. A terminal of an electronic lottery system, the terminal comprising a programmable machine programmed to perform processing comprising:

obtaining a encrypting function H, a result function R and an encrypted random number H(x) published by a server of the electronic lottery system;

providing to the server a random number ri;

receiving a lottery result R(x, r), a random number x, and random numbers ri published by the server, the random numbers ri being respective random numbers generated by terminals of the electronic lottery system;

verifying the random number x using the encrypting function H and the encrypted random number H(x); and verifying the lottery result R(x, r) using the result function R, the random number x, and the random numbers ri.

5. The terminal claimed in claim 4, wherein the result function R is a first hash function.

6. The terminal claimed in claim 4, wherein the encrypting function H is a second hash function.

7. A server for an electronic lottery system, the server comprising a programmable machine programmed to perform processing comprising:

generating a random number x;

determining a encrypting function H and a result function R;

encrypting the random number x using the encrypting function H to generate an encrypted random number H(x);

publishing the encrypting function H, the result function R and the encrypted random number H(x);

receiving from terminals (j) of the lottery system respective encrypted random numbers H(yj);

publishing the encrypted random numbers H(yj);

receiving from the terminals (j) respective random numbers yj;

verifying said respective random numbers yj using the encrypting function H and corresponding encrypted random numbers H(yj);

calculating a lottery result R(x, y) using the result function R, the random number x, and the random numbers yj; and publishing the lottery result R(x, y) the random number x, and the random numbers yj.

8. The server claimed in claim 7, wherein the result function R is a first hash function.

9. The server claimed in claim 7, wherein the encrypting function H is a second hash function.

10. A terminal of an electronic lottery system, the terminal comprising a programmable machine programmed to perform processing comprising:

obtaining a encrypting function H, a result function R and an encrypted random number H(x) published by a server of the electronic lottery system;

providing to the server an encrypted random number H(yj) generated using a random number yj and the encrypting function H;

receiving encrypted random numbers H(yj) published by the server, the encrypted random numbers H(yj) being respective encrypted random numbers generated by terminals of the electronic lottery system;

sending said random number yj to the server;

receiving a lottery result R(x, y), a random number x, and random numbers yj published by the server, the random numbers yj being respective random numbers corresponding to said encrypted random numbers H(yj);

verifying the random number x using the encrypting function H and the encrypted random number H(x);

verifying the respective random numbers yj using the encrypting function H and corresponding encrypted random numbers H(yj); and verifying the lottery result R(x, y) using the result function R, the random number x, and the random numbers yj.

11. The terminal claimed in claim 10, wherein the result function R is a first hash function.

12. The terminal claimed in claim 10, wherein the encrypting function H is a second hash function.

13. A server for an electronic lottery system, the server comprising a programmable machine programmed to perform processing comprising:

generating a random number x;

determining a encrypting function H and a result function R;

encrypting the random number x using the encrypting function H to generate an encrypted random number H(x);

publishing the encrypting function H, the result function R and the encrypted random number H(x);

receiving from terminals (i) of the lottery system respective random numbers ri;

receiving from terminals (j) of the lottery system respective encrypted random numbers H(yj);

publishing the random numbers ri and the encrypted random numbers H (yj);

receiving from the terminals (j) respective random numbers yj;

verifying said respective random numbers yj using the encrypting function H and corresponding encrypted random numbers H(yj);

calculating a lottery result R(x, r, y) using the result function R, the random number x, and the random numbers ri and yj; and publishing the lottery result R(x, r, y) the random number x, and the random numbers ri and yj.

14. The server claimed in claim 13, wherein the result function R is a first hash function.

15. The server claimed in claim 13, wherein the encrypting function H is a second hash function.

16. A terminal of an electronic lottery system, the terminal comprising a programmable machine programmed to perform processing comprising:

obtaining a encrypting function H, a result function R and an encrypted random number H(x) published by a server of the electronic lottery system;

providing to the server a random number ri;

receiving encrypted random numbers H(yj) published by the server, the encrypted random numbers H(yj) being respective encrypted random numbers yj generated by terminals (j) of the electronic lottery system;

receiving a lottery result R(x, r, y), a random number x, and random numbers ri and yj published by the server, the random numbers ri being respective random numbers generated by terminals (i) of the electronic lottery system, and the random numbers yj being respective random numbers generated by the terminals (j) of the electronic lottery system;

verifying the random number x using the encrypting function H and the encrypted random number H(x);

verifying the respective random numbers yj using the encrypting function H and corresponding encrypted random numbers H(yj); and verifying the lottery result R(x, r, y) using the result function R, the random number x, and the random numbers ri and yj.

17. The terminal claimed in claim 16, wherein the result function R is a first hash function.

18. The terminal claimed in claim 16, wherein the encrypting function H is a second hash function.

19. A terminal of an electronic lottery system, the terminal comprising a programmable machine programmed to perform processing comprising:

obtaining a encrypting function H, a result function R and an encrypted random number H(x) published by a server of the electronic lottery system;

providing to the server an encrypted random number H(yj) generated using a random number yj and the encrypting function H;

receiving encrypted random numbers H(yj) published by the server, the encrypted random numbers H(yj) being respective encrypted random numbers generated by terminals (j) of the electronic lottery system;

sending said random number yj to the server;

receiving a lottery result R(x, r, y), a random number x, and random numbers ri and yj published by the server, the random numbers ri being respective random numbers generated by terminals (i) of the electronic lottery system, and the random numbers yj being respective random numbers generated by said terminals (j) of the electronic lottery system;

verifying the random number x using the encrypting function H and the encrypted random number H(x);

verifying the respective random numbers yj using the encrypting function H and corresponding encrypted random numbers H(yj); and verifying the lottery result R(x, r, y) using the result function R, the random number x, and the random numbers ri and yj.

20. The terminal claimed in claim 19, wherein the result function R is a first hash function.

21. The terminal claimed in claim 19, wherein the encrypting function H is a second hash function.

* * * * *